US005729910A

United States Patent [19]

Marschke

[11] Patent Number: 5,729,910

[45] Date of Patent: Mar. 24, 1998

[54] ROTARY DRYING DRUM

[75] Inventor: Carl R. Marschke, Phillips, Wis.

[73] Assignee: Marquip, Inc., Phillips, Wis.

[21] Appl. No.: 739,326

[22] Filed: Oct. 29, 1996

[51] Int. Cl.[6] ..... D06F 58/00

[52] U.S. Cl. ..... 34/119; 34/121; 34/124

[58] Field of Search ..... 34/111, 114, 115, 34/116, 117, 119, 120, 121, 122, 123, 124

[56] References Cited

U.S. PATENT DOCUMENTS

| | | | |
|---|---|---|---|
| 2,365,678 | 12/1944 | Butler | 34/119 |
| 3,228,462 | 1/1966 | Smith, Jr. | 34/119 |
| 3,394,041 | 7/1968 | Ligt | 34/115 |
| 3,919,783 | 11/1975 | Cirrito | 34/115 |
| 5,134,786 | 8/1992 | Sanz | 34/115 |
| 5,301,521 | 4/1994 | Bertoldo | 68/5 D |

FOREIGN PATENT DOCUMENTS

| | | | |
|---|---|---|---|
| WO89/09690 | 10/1989 | WIPO | 34/116 |

*Primary Examiner*—Henry A. Bennett
*Assistant Examiner*—Pamela A. O'Connor
*Attorney, Agent, or Firm*—Andrus, Sceales, Starke & Sawall

[57] ABSTRACT

A rotary drying drum for a moving web includes a stationary heater drum positioned coaxially within the drying drum such that the drying drum rotates around the heater drum. The heater drum may be supplied with steam via a hollow drying drum shaft without the use of high pressure steam joints. Heat from the interior heater drum is transferred to the rotary drying drum wall by a thin layer of suitable heat exchange fluid confined to the annular space between the coaxial drum walls. A low melting point bismuth/lead/tin alloy is the preferred heat exchange fluid.

7 Claims, 1 Drawing Sheet

ROTARY DRYING DRUM

BACKGROUND OF THE INVENTION

The present invention relates to an apparatus for drying a running web of material by wrapping the same around the surface of a rotary drying drum and, more particularly, to an improved apparatus for internally heating the rotary drying drum.

In the manufacture of web materials or in conversion of webs to other products, such as formation of composite laminated webs or the manufacture of corrugated paperboard, it is often necessary or helpful to apply heat to the web material. The heat may be utilized to condition the web material, remove moisture from the web, or cure an adhesive which has been applied to one or more component webs.

Many different means and different mediums have been utilized to heat the interior of a rotary drying drum such that the heat may be transferred through the cylindrical outer drum wall to the web being carried thereon. One of the most commonly used heating fluids is steam because of its relatively low cost and common availability. In the production of corrugated paperboard, for example, steam is utilized to heat a number of pieces of equipment used in the process and, therefore, the use of steam for heating rotary drying drums is common in the corrugated industry.

When live steam is used to heat the interior of a rotary drum, the steam is fed through a hub on the rotary drum axis, and high pressure rotary steam joints are needed both for a steam inlet line and for the condensate outlet line. In addition, when steam is applied to the interior of a rotating drum or roll, the condensate is caused to form a layer on the entire interior drum surface by centrifugal force or drum rotation. This layer of water condensate inhibits efficient heat transfer to the drum wall.

BRIEF SUMMARY OF THE INVENTION

In accordance with the present invention, the interior of a rotary drying drum may be heated with steam without the use of high pressure rotary steam joints and in a manner which obviates the coating of the drum interior with a layer of condensate.

The rotary drying drum of the present invention, which is utilized to dry a moving web of material that is wrapped at least partially around an outer cylindrical drying surface of the drum, includes a generally cylindrical outer shell defining the outer surface, means supporting the outer shell for rotation on its axis, a closed cylindrical heater drum mounted coaxially within the cylindrical shell and fixed therein against rotation, the heater drum having a cylindrical outer shell which is spaced radially inwardly of the cylindrical shell of the drying drum and defining therewith a cylindrical annular space, means for heating the heater drum, and a heat exchange fluid filling the annular space.

The means for supporting the drying drum outer shell includes enclosing end walls for said outer shell, and hub means centrally located in the end walls. Means are also provided for supplying a heating fluid through the hub means to the interior of the heater drum. The heating fluid preferably comprises steam. Means are also provided for withdrawing steam condensate from the interior of the heater drum through the hub means. In the preferred embodiment, the heat exchange fluid which fills the annular space and comprises a low melting point metal alloy.

DETAILED DESCRIPTION OF THE INVENTION

Figure 1:
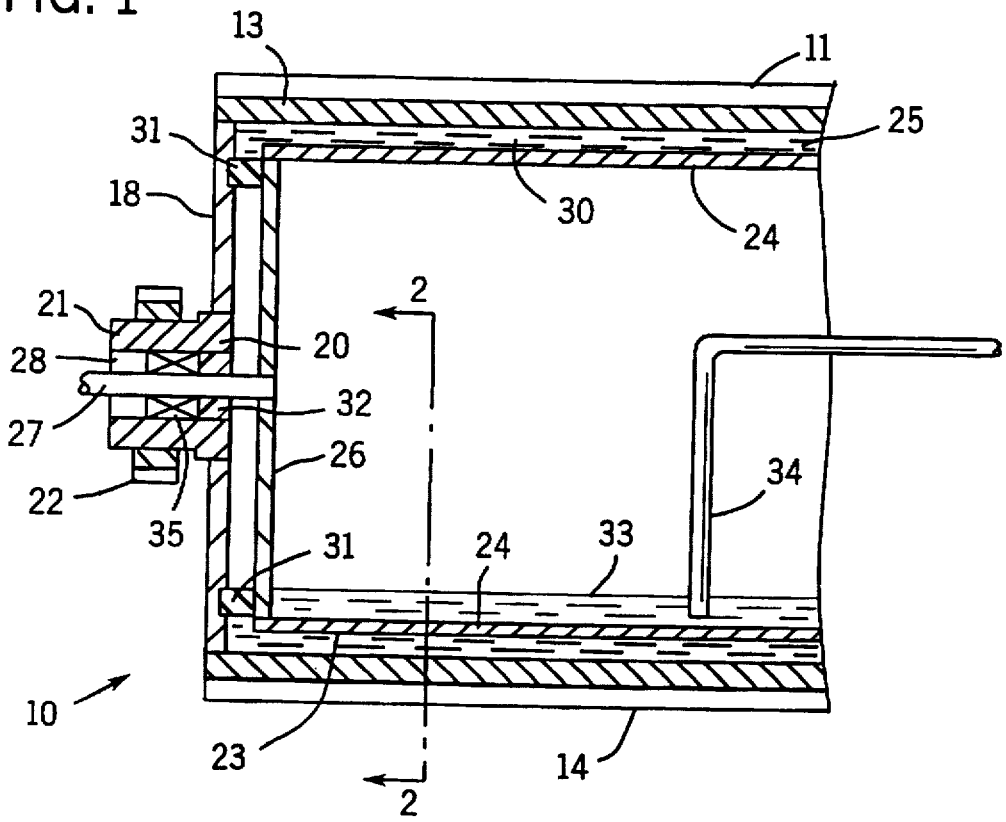
FIG. 1 is a partial sectional view taken on a plane through the axis of rotation of a rotary drying drum of the present invention.
Figure 2:
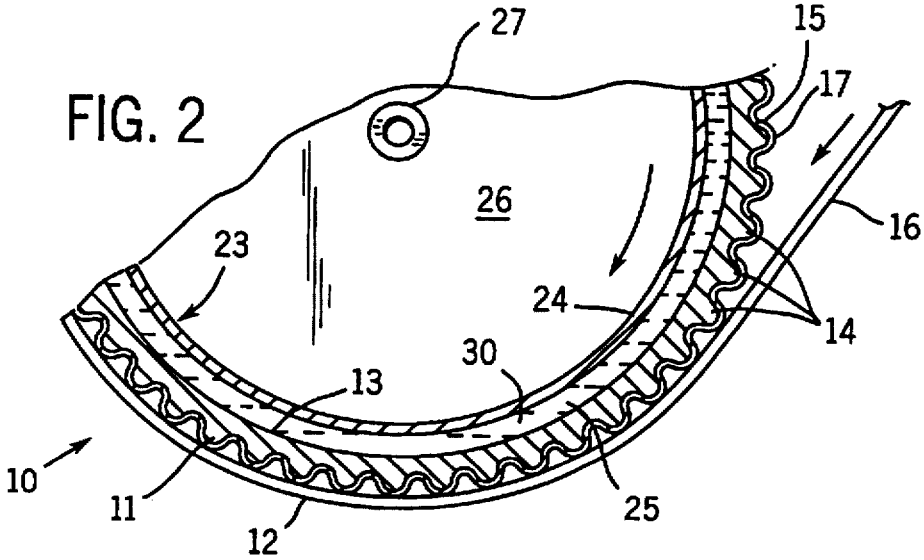
FIG. 2 is a partial sectional view taken on line 2—2 of FIG. 1.

A rotary drying drum 10, incorporating the subject invention, is shown in the drawing in the particular embodiment of a transfer roll 11 for a single facer utilized in the manufacture of corrugated single face web 12. It is to be understood, however, that generally cylindrical drums for drying or treating any type of unitary or composite web material in which the web is caused to contact at least a portion of the drum surface may utilize the subject invention.

A conventional transfer roll 11 includes a cylindrical outer shell 13, the outside surface of which is provided with a pattern of teeth or flutes 14 which carry a conventional corrugated medium web 15 to which a liner web 16 is adhesively attached. The transfer roll 11 may also interact with another interengaging fluted roll (not shown) to form the actual nip in which the medium web 15 is corrugated. The exposed flute tips 17 of the corrugated medium web 15 are coated with a suitable adhesive upstream of the point where the liner web 16 is brought into tangent contact with the medium web, all in a manner well known in the industry. As is also well known in the art, a rotary pressure roll or some other type of pressure device is typically used to press the freshly glued single face web 12 against the surface of the transfer roll 11, while heat is applied to the web to cure the adhesive. However, it is also known that high contact pressures from the pressure roll result in high noise and sometimes damage the single face web 12. More effective and efficient heat transfer to the web may allow the use of low pressure or no pressure curing of the adhesive in a single face web.

The cylindrical outer shell 13 of the drum 10 is enclosed by end walls 18 and, in a conventional manner, each of the end walls 18 is attached to a central hub 20 (only one of which is shown in FIG. 1). The hub 20 may be attached to or form the end of an integral shaft 21 to which rotary driving power is applied, such as via a drive gear 22, by an external prime mover. The shaft 21 on opposite ends of the drum may be supported in suitable bearings (not shown) in a conventional manner.

A closed cylindrical heater drum 23 is mounted coaxially within the cylindrical outer shell 13 of the drying drum 10 in a manner whereby the heater drum is fixed against rotation. The heater drum 23 has a cylindrical outer wall 24 which is spaced radially inwardly of the interior of the cylindrical outer shell 13 to define therewith a narrow cylindrical annular space 25. The heater drum 23 has opposite flat circular end walls 26 to define an enclosed heater drum interior.

Steam or another suitable heating fluid is supplied to the interior of the heater drum 23 by an axial inlet pipe 27 mounted centrally in one circular end wall 26. The inlet pipe 27 extends axially through the open interior 28 of the main drying drum shaft 21 to an external supply of steam or other heating fluid. Because the heater drum 23 and inlet pipe 27 are fixed with respect to the rotary drying drum 10, the use of a high pressure rotary steam joint is unnecessary.

The relatively thin cylindrical annular space 25 between the drum outer shell 13 and heater drum wall 24 is filled with a suitable heat exchange fluid 30 to provide direct heat transmission from the heater drum 23 to the rotary drying drum 10. Any suitable heat transmitting fluid may be utilized, including gases. However, a heat exchange liquid is preferred because of the generally better heat capacity. One particularly suitable material is a low melting metal alloy material which becomes liquid at temperatures substantially below the normal operating temperature of the rotary drying drum. For example, a metal alloy comprising equal parts lead, tin and bismuth has a melting point of 258° F. (126° C.). Even more preferable, however, is a similar alloy comprising 52.5% bismuth, 32% lead, and 15.5% tin. This alloy has a melting point of 203° F. (95° C).

The heat exchange material 30 is preferably confined to the cylindrical annular space 25 in order to concentrate the heat transfer to the outer shell 13 of the drum 10. Thus, a suitable annular seal 31 may be provided between the radial outer edge faces of the rotary drum end walls 18 and the heater drum end walls 26. Although only one end of the drum is shown in FIG. 1, it is understood that similar seal 31 would be provided on the other end as well. The annular seal 31 may be of any suitable type, but preferably comprises a low friction wiping seal. Alternately, a cylindrical seal 32 could be provided between the inlet pipe 27 and the open interior 28 of the shaft 21.

Because the heater drum 23 is maintained in a stationary position relative to rotation of the drying drum 10, the steam condensate 33 will accumulate at the bottom of the drum. A condensate pipe 34 of generally L-shape is supported within the heater drum 23 with an open lower end closely spaced from the bottom of the drum wall 24. The opposite end of pipe 34 extends through the open interior 28 of the main drum shaft 21 on the end of the drum opposite the inlet pipe 27 in a manner similar to that previously described. Outside of the drum 10, the condensate pipe 34 is connected to suitable pump or siphon mechanism to withdraw the condensate water. Thus, condensate will not remain as a constant layer on the interior surface of the heater drum wall 24, as it would if the drum were rotating.

If necessary, support with a suitable rotary cylindrical bearing 35 may be provided between the shaft 21 and the inlet pipe 27. A similar bearing 35 may also be provided between the shaft and the condensate pipe 34 on the opposite end of the drum.

I claim:

1. A heated rotary drum for drying a moving web of material wrapped at least partly around an outer cylindrical drying surface of the drum, said drum comprising:

a generally cylindrical outer shell defining the outer drum surface;

means supporting the outer shell for rotation on its axis;

a closed cylindrical heater drum mounted coaxially within said cylindrical shell and fixed against rotation, said heater drum having a cylindrical outer wall spaced radially inwardly of said cylindrical shell and defining therewith a closed annular cylindrical space;

means for supplying a heating fluid to the interior of said heater drum; and, a heat exchange fluid separate from the heating fluid filling said annular space.

2. The apparatus as set forth in claim 1 wherein said supporting means includes;

enclosing end walls for said outer shell; and, hub means centrally located in said end wall.

3. The apparatus as set forth in claim 2 wherein said means for supplying a heating fluid comprises an axial inlet extending through said hub means to said heater drum.

4. The apparatus as set forth in claim 3 wherein said heating fluid comprises steam.

5. The apparatus as set forth in claim 4 including means for withdrawing steam condensate from the interior of said heater drum through said hub means

6. The apparatus as set forth in claim 1 wherein said heat exchange fluid comprises a low melting point metal alloy.

7. The apparatus as set forth in claim 6 wherein said low melting point metal alloy is comprised of bismuth, lead and tin.

* * * * *